US005892322A

United States Patent [19]

Muchi et al.

[11] Patent Number: 5,892,322

[45] Date of Patent: Apr. 6, 1999

[54] ELECTRON GUN HAVING SPACER PLACED BETWEEN FIRST AND SECOND ELECTRODE

[75] Inventors: Tsuneo Muchi; Kenichi Ozawa; Shigenori Tagami, all of Kanagawa, Japan

[73] Assignee: Sony Corporation, Tokyo, Japan

[21] Appl. No.: 863,309

[22] Filed: May 27, 1997

[30] Foreign Application Priority Data

May 30, 1996 [JP] Japan ..... 8-136373

[51] Int. Cl.[6] ..... H01J 29/50

[52] U.S. Cl. ..... 313/417; 313/446; 313/243; 313/250

[58] Field of Search ..... 313/417, 446, 313/243, 250, 257

[56] References Cited

U.S. PATENT DOCUMENTS 4,720,654 1/1988 Hernqvist et al. ..... 313/417
5,424,606 6/1995 Karasawa et al. ..... 313/446
5,479,067 12/1995 Wilk et al. ..... 313/417

*Primary Examiner*—Vip Patel
*Attorney, Agent, or Firm*—Ronald P. Kananen; Rader, Fishman & Grauer PLLC

[57] ABSTRACT

An electron gun without deviation of diameter between grids, having a good object point diameter shape, and having a high cut-off voltage, which is cheap and has high performance, and a cathode ray tube provided with the same. The electron gun is provided with a spacer of a columnar shape which has surfaces facing each other on its two end surfaces, a beam aperture penetrating the spacer between the end surfaces, and conductive films provided on the two end surfaces, in which at least the circumferential wall of the beam aperture is constituted by a high resistance conductive material, the conductive films being used to constitute the grids and the beam aperture being constituted as an aperture for an electron beam.

6 Claims, 9 Drawing Sheets

ELECTRON GUN HAVING SPACER PLACED BETWEEN FIRST AND SECOND ELECTRODE

BACKGROUND OF THE INVENTION

1. Field of the Invention

The present invention relates to an electron gun in which distortion of an object point diameter etc. of an electron beam is reduced and a cathode ray tube provided with such an electron gun.

2. Description of the Related Art

In a color cathode ray tube (CRT), as shown in for example FIG. 1, a vacuum envelope is constituted by a panel 10, a funnel 11, and a neck 12. The panel 10 and the funnel 11 are bonded by frit glass 13. A phosphor surface coated with phosphors emitting lights of blue, green, and red is formed on an inner surface of the panel 10, and a color selection mask 21 is arranged close to this phosphor surface. An electron beam from an electron gun 30 accommodated in the neck 12 is deflected to a predetermined direction by a not illustrated deflection yokes. The beam passes through the color selection mask 21, reaches the phosphor surface formed on the inner surface of the panel 10, excites the predetermined phosphors, and makes them emit the light.

This electron gun 30 is a unipotential type and causes convergence of electrons emitted from red, green, and blue cathodes K1 to K3 onto the phosphor surface by the action of a prefocus lens constituted by a first grid $G_1$, a second grid $G_2$, and a third grid $G_3$ and a main lens constituted by a third grid $G_3$, a fourth grid $G_4$, and a fifth grid $G_5$. These grids are arranged so as to be coaxial.

An enlarged view of a conventional cathode K and prefocus lens system is given in FIG. 2. The first grid $G_1$, the second grid $G_2$, and the third grid $G_3$ are assembled so as to be coaxial by fixing them to predetermined jigs and inserting their respectively provided connection pins $CP_1$ to $CP_3$ in melted bead glass BG. In the past, the precision of this assembly process has been a problem.

A model of the cathode lens system is shown in FIG. 3. The electron beam EB emitted from the cathode K is focused sharply to form a beam by the action of the first grid $G_1$ and the second grid $G_2$ and then expands. The smallest diameter of the beam will be referred to as an object point diameter Øc. This object point diameter Øc becomes an effective image of the convergence lens after this. Any axial deviation of an aperture diameter $Ø_1$ of the first grid $G_1$ and $Ø_2$ of the second grid $G_2$ and lack of parallelism of the distance $d_{12}$ between the first grid $G_1$ and the second grid $G_2$ exert an adverse influence upon the shape and distortion of the object point diameter Øc formed by the cathode lens. In order to secure sufficient precision, steps have been taken with respect to the jigs and steps have been taken such as provision of guide holes in the first grid $G_1$, second grid $G_2$, etc., but they have not yet been sufficient.

An example of an electron gun designed to improve the precision of assembly is shown in FIGS. 4 and 5. This electron gun has a structure in which the first grid $G_1$ and the second grid $G_2$ are fixed in place via a ring-like spacer 33 made of an insulating material. In the assembly of this electron gun, first, as shown in FIG. 5, which is an enlarged view of the part surrounded by a circle in FIG. 4, metallized layers 33*a* composed of Mo—Mn are formed by sintering on the two end surfaces of a ring-like spacer 33 constituted by an insulator mainly composed of $Al_2O_3$, then a Ni plating 33*b* is applied. Silver solder 33*c* is interposed between this spacer 33 and the first grid $G_1$ and the second grid $G_2$, then the assembly is mounted on a jig for positioning the spacer 33, the first grid $G_1$, and the second grid $G_2$ is subject to heat treatment in a hydrogen furnace so as to bond the parts together.

In the production of this electron gun, however, nickel plating and brazing are carried out after metallizing the ceramic and other numerous steps are performed, so the process becomes expensive. In effect as well, only improvement of the beam spot diameter due to an improvement of the dimensional precision can be expected.

On another matter, as a cut-off voltage $E_{kco}$ of the electron gun, the following Equation (1) has been known.

$$E_{kco} \alpha (Ø_1^3 / d_{10} \cdot d_{12i} \cdot t_1) \cdot t \quad (1)$$

The symbols in the equation are the same as the symbols shown in FIG. 3, that is, $Ø_1$ is the aperture diameter of the first grid $G_1$, $d_{10}$ is a distance between the cathode K and the first grid $G_1$, $d_{12}$ is a distance between the first grid $G_1$ and the second grid $G_2$, and $t_1$ is a plate thickness of the first grid $G_1$. The higher the cut-off voltage, the larger the number of white and black gradations and thus the better the quality of the image. It is seen from this equation that the smaller the thickness $t_1$ of the first grid $G_1$, the higher the cut-off voltage $E_{kco}$.

However, the grid is formed by a metal plate such as a stainless steel plate, therefore the thickness thereof is about 50 $\mu$m. It is difficult to reduce the thickness more than this so long as the grid is formed by a metal plate.

On the other hand, the bead glass BG shown in FIG. 2 is assembled integrally also with the fourth grid $G_4$ and the fifth grid $G_5$. When the electron gun is used, for example, an anode voltage (20 to 30 kV) is applied to the third grid $G_3$ and the fifth grid $G_5$, and a medium voltage of 10 to 5 kV is applied to the fourth grid $G_4$. These are higher in comparison with the about 700 V of the second grid $G_2$, therefore the bead glass BG is charged and also the first grid $G_1$ connection pin portion $CP_1$ is given a high voltage. In order to eliminate the effect of charging this bead glass BG with a high voltage, it is necessary to make the distance $d_{12}$ between the first grid $G_1$ and the second grid $G_2$ sufficiently smaller with respect to the outer diameter of the first grid $G_1$ and the second grid $G_2$. By rule of thumb, it is necessary to make the same about 1/10.

The same is true also for the electron gun shown in FIG. 4. Even when the voltage applied to the second grid $G_2$ is set to 200 V, again, to eliminate the effect of charging the spacer (insulator) 33, as the shape of the second grid $G_2$ shown in FIG. 2, it is necessary to adopt a configuration in which $d_{12}$ is made sufficiently narrow by forming a convex portion on the first grid $G_1$ side. There are therefore restrictions on the structure.

SUMMARY OF THE INVENTION

An object of the present invention is to provide an electron gun without any deviation of diameter between grids, having a good object point diameter, having a high cut-off voltage, and in addition being resistant to the influence of charging at its periphery, which is cheap and has a high performance and a cathode ray tube provided with the same.

To achieve the above object, the present invention provides an electron gun having a spacer of a columnar shape which has surfaces facing each other on the two end surfaces, a beam aperture penetrating the spacer between the facing end surfaces, and conductive films provided on the two facing end surfaces, in which at least the circumferential wall of the beam aperture is constituted by a high resistance conductive material; the conductive films are constituted as grids; and the beam aperture is constituted as an aperture of an electron beam.

Further, to achieve the above object, the present invention provides a cathode ray tube which is provided with an electron gun wherein provision is made of a spacer of a columnar shape which has surfaces facing each other on the two end surfaces, a beam aperture penetrating the spacer between the facing end surfaces, and conductive films provided on the two facing end surfaces, in which at least the circumferential wall of the beam aperture is constituted by a high resistance conductive material; the conductive films are constituted as grids; and the beam aperture is constituted as an aperture of an electron beam.

As stated above, the electron gun of the present invention has a structure using a columnar spacer with two end surfaces facing each other, with conductive films formed on the two end surfaces of this spacer, and with these conductive films formed as the grids. An electron beam is passed through the beam aperture penetrating the spacer between the two end surfaces. At least the circumferential wall of this beam aperture is constituted by a high resistance conductive material.

For this reason, the diameters $Ø_1$ and $Ø_2$ of the grids are determined by just the precision of the diameter obtained by machining since they are integrally formed by the spacer, so no deviation of the diameter of the grids occur. The parallelism of the grids is determined by the machining precision of the two end surfaces of the spacer. As a result, the path of the electron beam is not distorted, and the resolution can be improved while reducing the distortion of the object point diameter.

Further, since the high resistance conductive material of the spacer constitutes the space between the grids, a very small current flows between these grids, and a stable and continuous potential is obtained without charge-up. For this reason, there is no effect of the charge-up etc. on the bead glass etc., so there is no unstability and disturbance of the electric field due to charge-up.

In an electron gun having the above configuration, since the grids can be formed by the machining of the material, an electron gun having a good performance can be cheaply obtained.

Further, since the cathode ray tube of the present invention is provided with such an electron gun, the size and shape of the electron beam spot on the phosphor surface do not deviate from those at the initial stage and the resolution is good.

BRIEF DESCRIPTION OF THE DRAWINGS

The above and other objects and features of the present invention will be more apparent from the following description of the preferred embodiments given with reference to the accompanying drawings, wherein.

DESCRIPTION OF THE PREFERRED EMBODIMENTS

Below, explanation will be made of an embodiment of the present invention, but of course the present invention is not limited to this embodiment.

Figure 6:
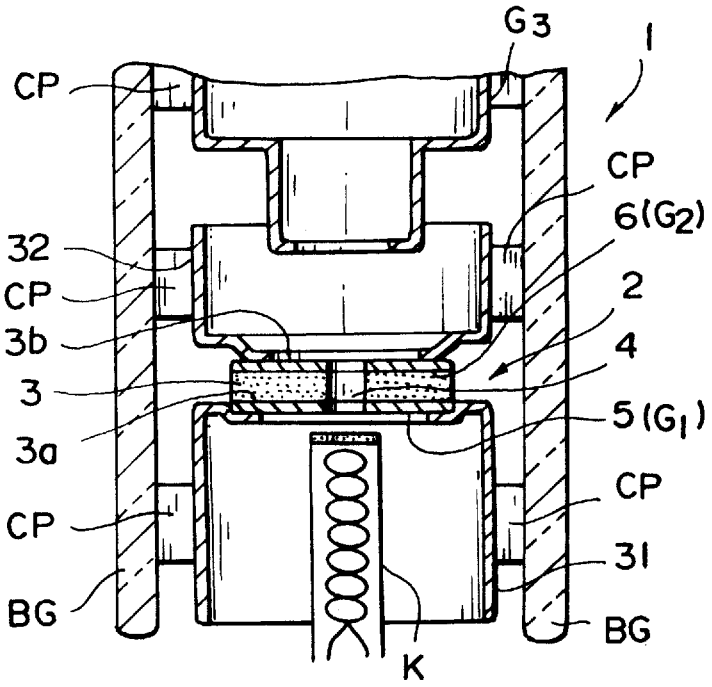
FIG. 6 is a sectional view of an example of a part of an electron gun of the present invention.

FIG. 6 is a sectional view of an example of an electron gun according to the present invention in which a spacer is used to constitute the first grid and the second grid. In this sectional view, the fourth grid $G_4$ and the fifth grid $G_5$ are omitted since they are the same as those of the conventional case, and the prefocus lens system of the first grid $G_1$ to the third grid $G_3$ is shown.

In this electron gun 1, a cylindrical spacer 2 having a short axis is arranged on the same axis as the neck at a position facing the cathode K. The two opposing end surfaces 3*a* and 3*b* of the spacer body 3 are preferably formed to be parallel with each other. A beam aperture 4 is made penetrating through the center of the spacer body 3 in the axial direction and through the two end surfaces. Conductive films 5 and 6 are formed on these two end surfaces. The conductive film 5 on the cathode K side constitutes the first grid $G_1$, and the conductive film 6 on the neck surface side constitutes the second grid $G_2$.

This spacer 2 is sandwiched between a first electrode 31 and a second electrode 32 formed by metal plate such as SUS-304 and thereby is supported at a predetermined position. At the same time, these electrodes 31 and 32 and the conductive films 5 and 6 are electrically connected and a predetermined voltage is applied from these electrodes 31 and 32 to the conductive films 5 and 6. Further, the third grid $G_3$ is provided on the neck surface side on the same axis as that of the spacer 1. Further, a not illustrated fourth grid $G_4$ and fifth grid $G_5$ are provided on the neck surface side on the same axis as that of the third grid $G_3$.

Figure 1:
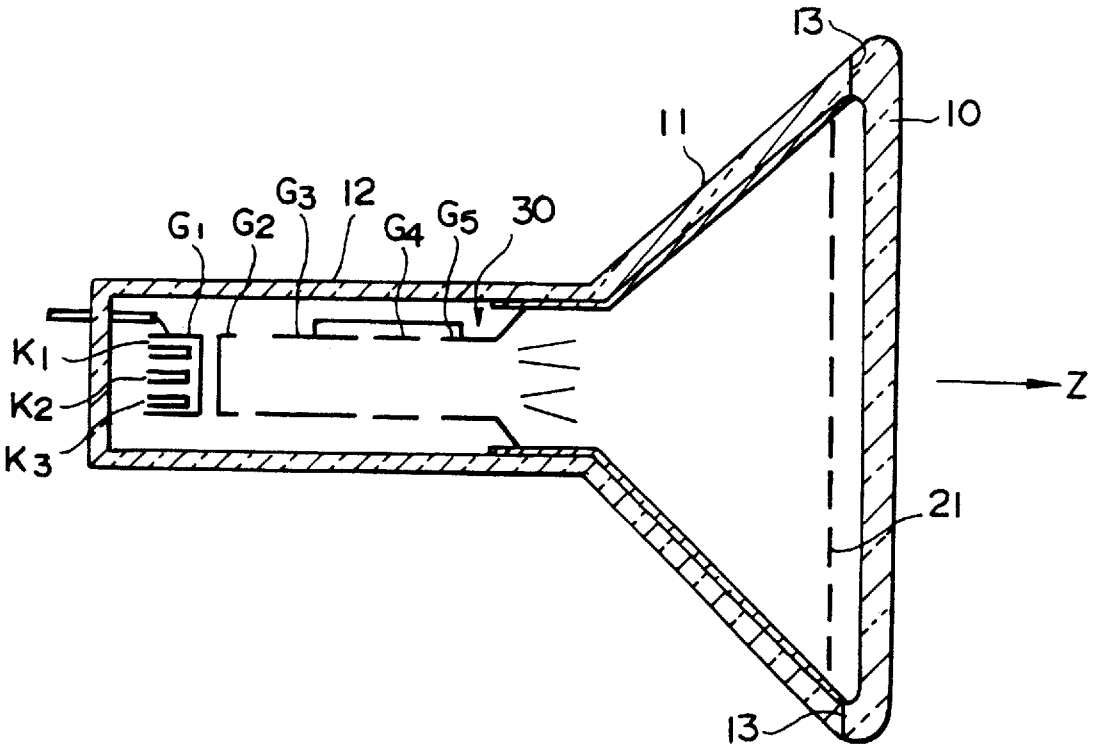
FIG. 1 is a sectional view of principal parts of the cathode ray tube.
Figure 2:
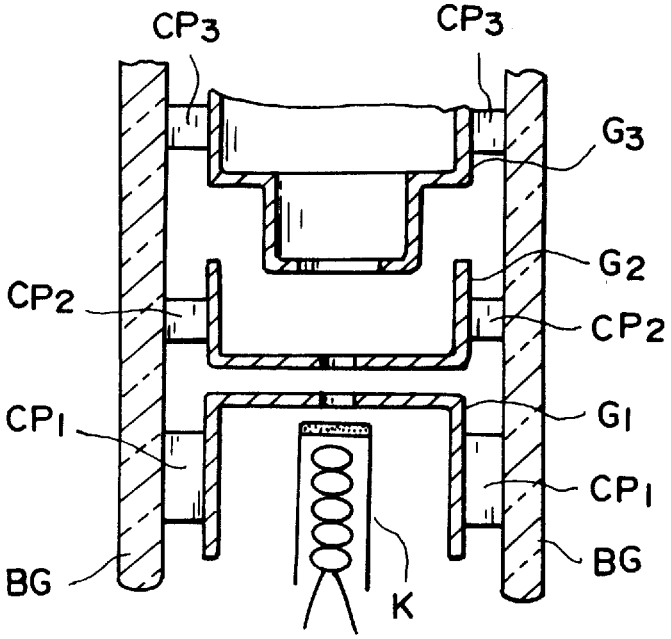
FIG. 2 is a sectional view of a part of a conventional electron gun.

The first electrode 31, the second electrode 32, and the third grid $G_3$ are respectively fixed to the bead glass BG via the connection pins CP. Although not illustrated, the cathode K, the first electrode 31, and the second electrode 32 are connected to the outside via a not illustrated stem by a lead for the power supply, respectively. For example, 0V is applied to the first electrode 31 (conductive film 5), and about 700V is applied to the second electrode 32 (conductive film 6). The third grid $G_3$ is connected to the fifth electrode $G_5$ as shown in FIG. 1 in the case of for example a unipotential type, and an anode voltage is applied to this.

Figure 7A:
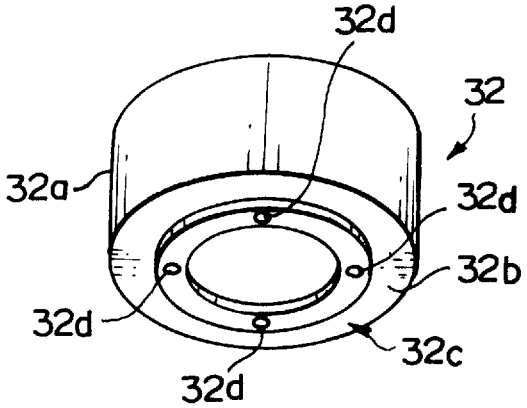
FIG. 7A is a perspective view of a second electrode.
Figure 7B:
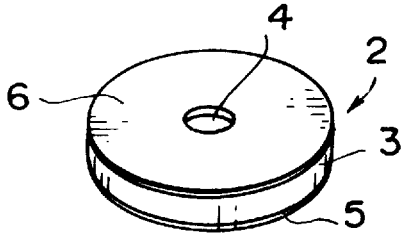
FIG. 7B is a perspective view of a spacer.
Figure 7C:
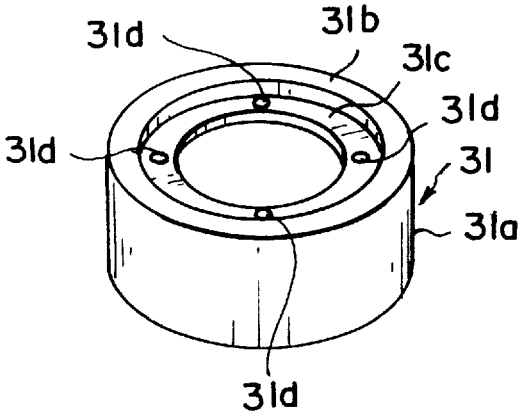
FIG. 7C is a perspective view of a first electrode.

Next, a detailed explanation will be made of the spacer 1, the first electrode 31, and the second electrode 32 shown in FIG. 6. FIGS. 7A to 7C are perspective views of an example of the first electrode 31, the spacer 2, and the second electrode 32.

First, an explanation will be made of the spacer 2—which is the characterizing feature of the present invention. As mentioned above, the spacer body 3 of the spacer 2 is constituted by a high resistance conductive material and can be given a short axis cylindrical shape having a diameter of about 4 mm and a thickness of about 3 mm. As this high resistance conductive material, there can be mentioned, for example, ceramics obtained by incorporating oxides of niobium, iron, manganese, titanium, copper, or tungsten into alumina ($Al_2O_3$) and sintering. The volume resistivity thereof is preferably about $10^6$ to $10^{14}$ Ω·cm at room temperature. Specifically, there can be mentioned a material composed of 85 percent of alumina and 15 percent of $MnO_2$—$Fe_2O_3$—$Nb_2O_3$ and having a volume resistivity at room temperature of about $10^{11}$ Ω·cm.

The conductive films 5 and 6 acting as the grids are formed on the end surfaces of the spacer body 3. These conductive films can be formed by using a material having a good heat resistance and resistance to oxidation such as a gold paste obtained by mixing a glass to for example Ni, Mo, gold solder {for example JIS: BAu-4 (V) composed of Au—Ni} or gold by means of, for example, vapor deposition, sputtering, or screen printing. The thickness of the conductive films 5 and 6 is not particularly limited, but can be set to for example about 0.1 to 20 μm.

Further, the beam aperture 4 formed at the axial center of the spacer 2 has for example an inner diameter of about 0.1 to 0.8 mm and penetrates the spacer body 3 between the two end surfaces. It can be formed for example at the time of shaping or formed later by cut and grinding. This beam aperture is for allowing the electrons emitted from the cathode to pass therethrough.

Figure 8:
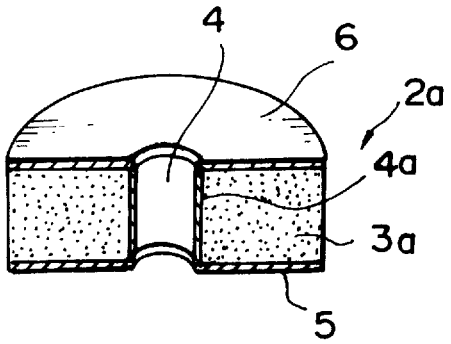
FIG. 8 is a perspective view, partially sectional, of an example of the spacer.

It is also possible to separately constitute the circumferential wall of this beam aperture by a high resistance conductive material film 4*a* as shown in FIG. 8. In this case, it is not necessary to constitute the spacer body 3*a* by the high resistance conductive material and is possible to constitute the same by a conventional insulating material such as plain alumina. Further, the high resistance conductive material film 4*a* is preferably electrically connected to the conductive films on the two end surfaces. The volume resistivity of the high resistance conductive material film 4*a* is preferably for example about $10^6$ to $10^{14}$ Ω·cm at ordinary temperature. If the resistivity is higher than this, it sometimes becomes difficult to pass a very small leakage current, while if the resistivity is lower, the leakage current becomes too large and the power consumption of the cathode ray tube sometimes becomes too large. Such a high resistance conductive material film 4*a* can be formed by adhering a glass paste containing as a main component for example lead glass and incorporating about 10 to 25 percent of a tin oxide or an antimony oxide to for example a fine rubber roller and coating this on the circumferential wall by insertion, contact, etc., and then sintering this at 500° to 585° C. As materials to which conductivity can be imparted, there are for example ruthenium oxide in addition to the above tin oxide and antimony oxide. Various materials can be selected from.

The first electrode 31, as shown in FIG. 7C, a constricted portion 31*b* for positioning the spacer is integrally provided inwardly on one edge of the cylindrical body 31*a*. A ring-like concave portion 31*c* into which the circumferential wall of the spacer 2 fits is provided at this constricted portion. Further, four projections (positioners) 31*d* in the figure are provided on the bottom side of this concave portion and ensure the electrical contact with respect to the conductive film 5 of the spacer 2.

On the other hand, in the second electrode 32, contrary to the first electrode 31, a constricted portion 32*b* is integrally provided inwardly on one edge of the cylindrical body 32*a*, and a ring-like convex portion 32*c* imparted with a spring property for pressing the spacer is formed in this constricted portion 32*b*. In the figure, four projections (positioners) 32*d* are provided on the flat portion of this convex portion 32*c*.

In the assembly of the electron gun including these first electrode 31, spacer 2, and second electrode 32, for example, the spacer 2 is inserted into the concave portion 31*c* of the first electrode 31 and the convex portion 32*c* of the second electrode 32 is made to abut against the spacer 2 to give pressure to this. In this state, they are respectively affixed to a jig for positioning the electron gun parts such as the first electrode 31, second electrode 32 and third grid $G_3$ to the fifth grid $G_5$. Then, the bead glass BG is melted and each connection pin CP formed on each is inserted into the bead glass, whereby the assembly of the electron gun 1 shown in FIG. 6 is completed.

Figure 5:
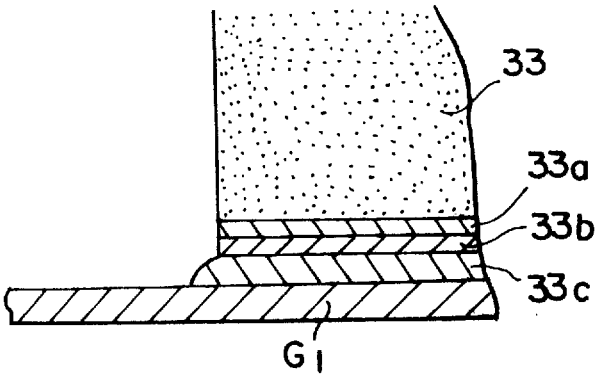
FIG. 5 is an enlarged sectional view of the part shown in the circle in FIG. 4.

This method is one example using bead glass. As explained by referring to FIG. 5, it is also possible to directly braze the conductive films 5 and 6 of the spacer 2 and the first electrode 31 and the second electrode 32 by using a brazing material. In this case, the bead glass becomes unnecessary. Note that, if a high resistance conductive material using an oxide is fixed in place in the hydrogen furnace explained by referring to FIG. 5, the oxide in the ceramic is reduced, and the conductivity sometimes becomes large. This point must be noted.

Figure 3:
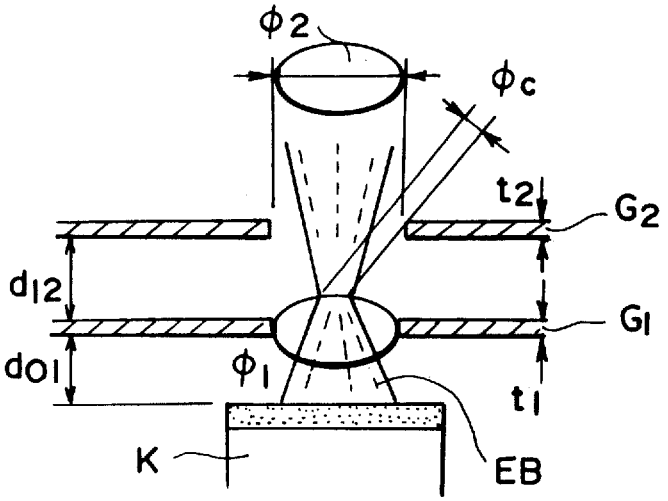
FIG. 3 is a view explaining the object point diameter of the electron beam due to the first grid and the second grid.
Figure 4:
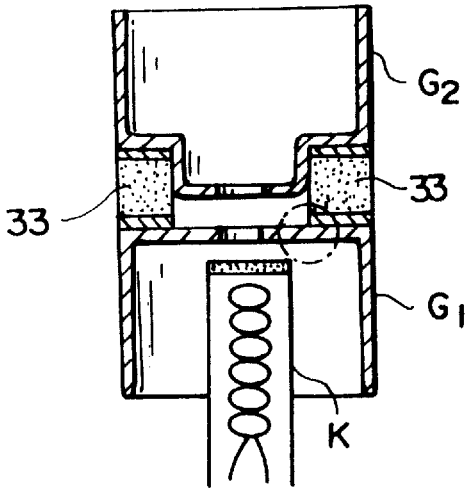
FIG. 4 is a sectional view of an example of an electron gun using a spacer of a conventional material.

In the electron gun of the present invention shown in FIG. 6 constituted in this way, the first grid $G_1$ is constituted by the conductive layer 5 formed on one surface of the spacer 2, and the second grid $G_2$ is constituted by the conductive layer 6 formed on the other surface of the spacer 2, respectively. The first electrode 31 and the second electrode 32 have the function of supporting and positioning the spacer 2 and of supplying power. The first grid diameter $Ø_1$ and the second grid diameter $Ø_2$ shown in FIG. 3 are diameters of the beam aperture 4 formed in the spacer 2, so the first grid diameter $Ø_1$ and the second grid diameter $Ø_2$ do not substantially suffer from deviation of the diameter. The precision of these grid diameters is determined according to the machining precision of the spacer, therefore grids having a good precision are easily obtained.

Further, since the first grid $G_1$ and the second grid $G_2$ are the conductive films 5 and 6 formed on the upper surface and the lower surface of a short axis cylindrical material such as a ceramic, the parallelism of the two grids 5 and 6 is determined by the machining precision of the ceramic, and the precision of parallelism is extremely good.

Since there is no deviation of diameter between these grids and the parallelism is good, the electron gun of the present invention can be formed with a predetermined shape while suppressing the distortion of the path of the electron beam and reducing the distortion of the object point diameter, therefore the resolution is good.

Further, since at least the circumferential wall of the beam aperture 4 of the spacer 2 is constituted by a high resistance conductive material, a very small current flows between the first grid $G_1$ and the second grid $G_2$, and it is possible to make the gradient of potential between grids smooth and prevent unstable fluctuation of the intermediate potential between grids. Further, when the electron beam passes near the center of the beam aperture 4, the circumferential wall which the leaked beam hits will not be charged.

Further, even if the charge of the bead glass BG is increased, it is possible to prevent the influence thereof from being exerted upon the electron beam due to the high resistance conductive material.

Note that, if calculating the power consumption in the case where the spacer body 3 is constituted by a high resistance conductive material assuming that the spacer outer diameter is 4 mm and the thickness is 3 mm, the beam aperture is ignored, the volume resistivity of the high resistance conductive material is $10^9$ $\mu\Omega\cdot$cm, the voltage applied to the first grid $G_1$ is 0V and the voltage applied to the second grid $G_2$ is 700V, then the leakage current becomes 0.29 $\mu$A and the power consumption becomes 0.2 mW or very small values.

Further, since the conductive films 5 and 6 of the spacer 2 can be formed thin, as shown by the above Equation (1), the cut-off voltage can be made high. For example, while the thickness of the grid constituted by a metal plate is about 50 $\mu$m, it is possible to form a grid to the thickness of about 10 $\mu$m by for example silk screen printing. Further, when vapor depositing a metal, a thickness of 1 $\mu$m or less is easily obtained. For this reason, if the thickness of the conductive film is 10 $\mu$m, it is seen from Equation (1) that the cut-off voltage becomes 5 times larger and the number of white and black gradations can be increased and thus the quality of the image can be improved.

Further, since the plate thickness $t_2$ of the second grid $G_2$ can be formed thin by printing or the like, the spherical aberration of the prefocus lens can be made small. This will be explained next.

Figure 11A:
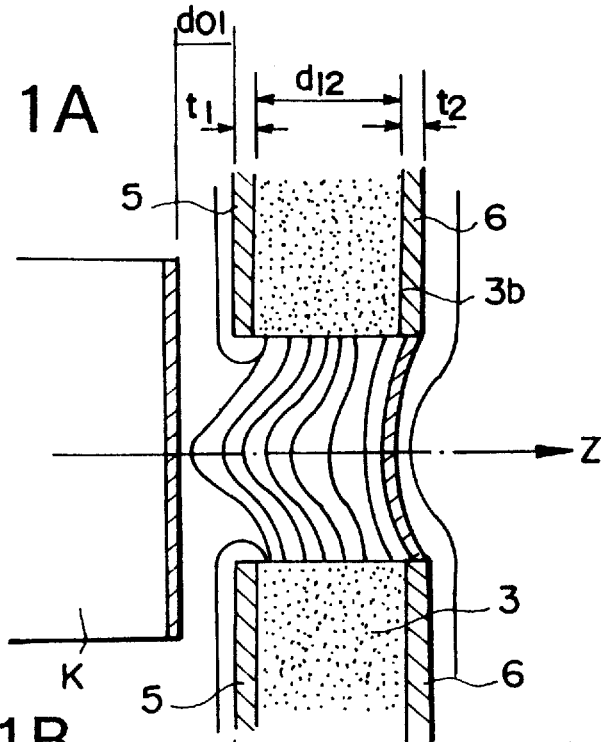
FIG. 11A is a view of the distribution of potential due to a first grid and a second grid of the electron gun of the present invention.
Figure 11B:
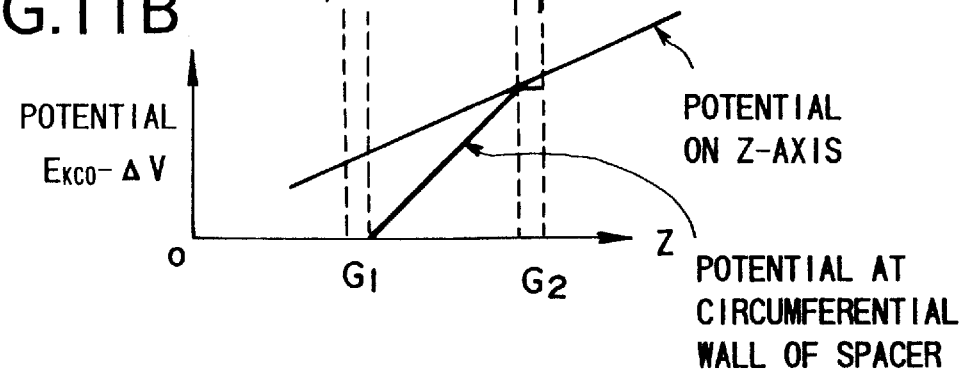
FIG. 11B is a view of a gradient of potential on a Z-axis.
Figure 12A:
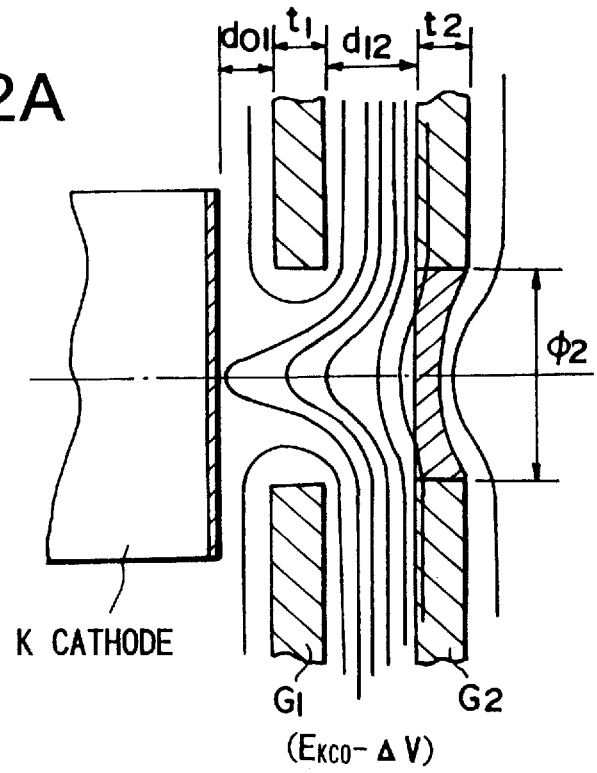
FIG. 12A is a view of the distribution of potential due to a first grid and a second grid of a conventional electron gun.
Figure 12B:
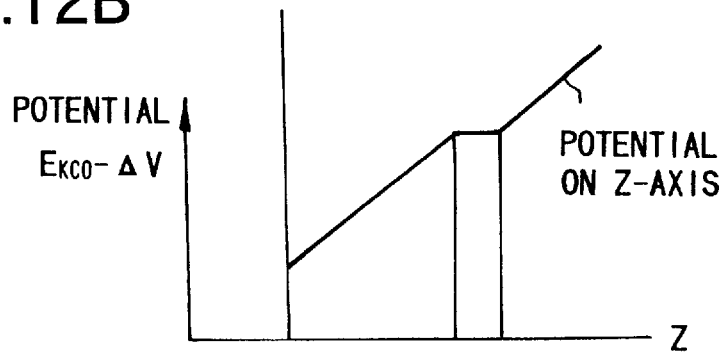
FIG. 12B is a view of a gradient of potential on the Z-axis.

FIG. 12A is a view of the distribution of potential at the peripheries of the first grid $G_1$ and the second grid $G_2$ constituted by the conventional metal plate and FIG. 12B is a view of the gradient of potential thereof on the Z-axis. On the other hand, the distribution of potential of the same part of the electron gun of the present invention is shown in FIG. 11A, and the gradient of potential thereof on the Z-axis is shown in FIG. 11B. When the gradient of potential of the conventional electron gun and the gradient of potential of the present invention are compared, since the thickness $t_2$ of the conductive film 3*b* is smaller in the electron gun of the present invention, an abrupt change of the gradient of potential can be eliminated in practice. Since the spherical aberration becomes smaller where the secondary differentiation with respect to the Z-axis of the potential becomes smaller, the spherical aberration can be made small.

In the assembly of such an electron gun, it is possible to adopt the method of assembly using bead glass the same as in the conventional method by merely separately preparing the spacer 2, therefore the electron gun of the present invention can be cheaply produced.

In the above embodiment, the explanation was made of the case where the spacer 2 was used to constitute the first grid $G_1$ and the second grid $G_2$, but it is also possible to use it to constitute the second grid and the third grid. In this case, it is possible to adopt a structure using a spacer having the conductive films and beam aperture similar to those described above, form the second grid and the third grid to shapes like the first electrode and the second electrode, and use these electrodes to hold the spacer and supply power.

Figure 9:
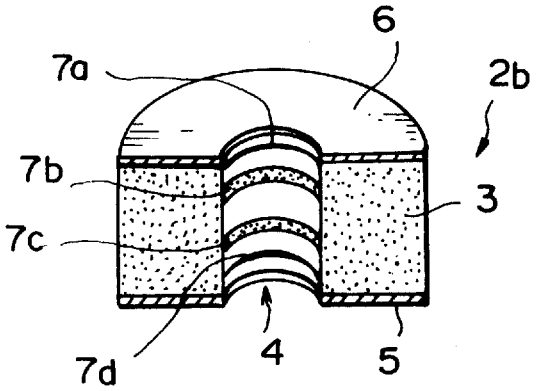
FIG. 9 is a perspective view, partially sectional, of another example of the spacer.

Further, preferably one or more (four in the figure) conductive rings (7*a* to 7*d*) spaced around the circumference of the beam aperture are formed on the circumferential wall of the beam aperture 4 of the spacer 2*b* as shown in FIG. 9. When the electron beam current becomes large, the scattered electrons and remaining gas are ionized and a dark current is increased. One part of this dark current impinges upon the surface of the material, generates secondary electrons, and charges the material surface. As a result, it has been confirmed that the beam spot on the phosphor surface becomes unfocused or the position thereof changes, but this phenomenon is considerably moderated by providing a conductive ring. Further, by providing the conductive ring, it is possible to freely change the gradient of potential between grids, make the spherical aberration coefficient small, and make the spot diameter small. The number, position, width, etc. of the conductive rings are determined by taking these into account.

The conductive rings 7*a* to 7*d* can be formed by coating by using for example $RuO_2$—glass paste (Trademark: #9516, made by Dupont). As the coating method, there is a method of placing a conductive glass paste on a flat plate in which a concave portion is formed with for example a predetermined pattern, rolling a filling roller to fill the conductive glass paste in the concave portion, rolling a transfer roller on this flat plate so that the conductive glass paste filled in the concave portion is adhered to the transfer roller in the form of a ring, inserting this transfer roller into the beam aperture, and pushing the roller against the circumferential wall of the beam aperture while rotating either of the roller or the spacer to transfer the image. After the conductive glass paste is coated, it is then sintered to end the formation of the conductive ring. Further, as another coating method, it is also possible to directly draw the ring by a dispenser. Further, it is also possible to perform the patterning by optical exposure.

Figure 10A:
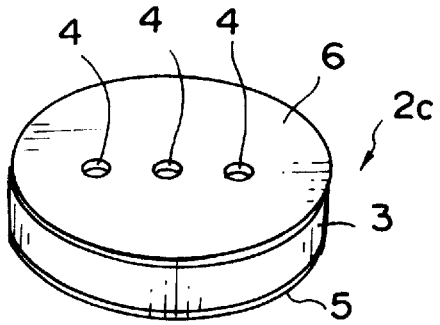
FIGS. 10A and 10B are perspective views of another example of the spacer.
Figure 10B:
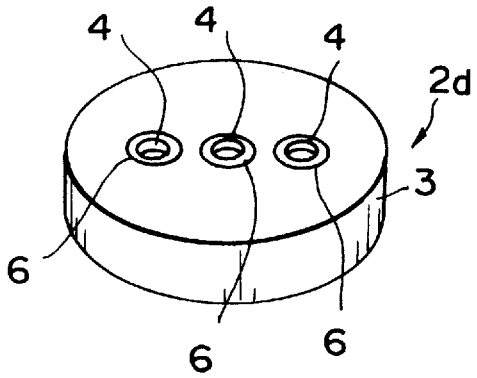

Further, in the above embodiment, an explanation was made of an example where one spacer was arranged with respect to one cathode, but as shown in FIGS. 10A and 10B, also a structure of providing beam apertures at positions corresponding to the cathode ray tube and using one spacer for three cathodes of R, G, and B of the color cathode ray tube can be adopted. In this case, it is also possible to form conductive films 5 and 6 on entire surfaces of the upper surface and lower surface of the spacer 2*c* as shown in FIG. 10A or independently provide the same on peripheries of the beam apertures 4 of the spacer 2*d* as shown in FIG. 10B.

In the electron gun of the present invention, as mentioned above, the spot diameter of the electron beam is improved in focus, therefore a cathode ray tube provided with such an electron gun has a high resolution.

An electron gun of the present invention can be cheaply produced while having high performance.

Further, since the cathode ray tube of the present invention is provided with such an electron gun having a high performance, it has a high resolution.

What is claimed is:

1. An electron gun comprising:

a spacer of columnar space which has surfaces facing each other on its two end surfaces, a beam aperture penetrating the spacer between the facing end surfaces, and conductive films acting as grids supported by the two facing end surfaces, and wherein at least the circumferential wall of the beam aperture is constituted by a high resistance conductive material; and said beam aperture is constituted as an aperture of an electron beam, wherein the beam aperture penetrates the conductive films such that substantially no deviation in the diameter of the beam aperture occurs.

2. An electron gun according to claim 1, wherein said spacer is sandwiched between a concave portion of a first electrode having a concave portion for accommodating the spacer and a second electrode having a spring action for generating a pressing force with respect to the spacer; the conductive films of the spacer and these electrodes are electrically connected; and, the spacer is held at a predetermined position.

3. An electron gun according to claim 1, wherein a ring-like conductive film is formed on the circumferential wall of the beam aperture.

4. An electron gun according to claim 1, wherein a plurality of beam apertures are formed, and each beam aperture is constituted so as to allow an electron beam to pass therethrough.

5. A cathode ray tube provided with an electron gun, comprising:

a spacer of a columnar shape which has surfaces facing each other on its two end surfaces, a beam aperture penetrating the spacer between the facing end surfaces, and conductive films acting as grids supported by the two facing end surfaces, and wherein at least the circumferential wall of the beam aperture is constituted by a high resistance conductive material; and said beam aperture is constituted as an aperture of an electron beam, wherein the beam aperture penetrates the conductive films such that substantially no deviation in the diameter of the beam aperture occurs.

6. An electron gun comprising:

at least one first electrode;

at least one second electrode;

a spacer of columnar space which has surfaces facing each other on its two end surfaces, said spacer being interposed between the first electrode and the second electrode;

conductive films acting as grids carried by the two facing end surfaces, wherein the conductive films and the spacer constitute the space between the first electrode and the second electrode;

a beam aperture penetrating the spacer between the facing end surfaces, wherein the beam aperture is constituted as an aperture of an electron beam, said beam aperture penetrating the conductive films such that substantially no deviation in the diameter of the beam aperture occurs; and wherein at least the circumferential wall of the beam aperture is constituted by a high resistance conductive material.

* * * * *